US007014380B2

(12) United States Patent
Ono et al.

(10) Patent No.: US 7,014,380 B2
(45) Date of Patent: Mar. 21, 2006

(54) COMPOSITE HOLDING TOOL

(75) Inventors: Masahiko Ono, Osaka (JP); Kazuya Watanabe, Osaka (JP); Tadao Odaka, Kawagoe (JP); Tadashi Keda, Kawagoe (JP)

(73) Assignees: Fujicopian Co., Ltd., Osaka (JP); Kotobuki & Co., Ltd., Kyoto (JP)

( * ) Notice: Subject to any disclaimer, the term of this patent is extended or adjusted under 35 U.S.C. 154(b) by 199 days.

(21) Appl. No.: 10/682,799

(22) Filed: Oct. 10, 2003

(65) Prior Publication Data

US 2004/0114985 A1 Jun. 17, 2004

(30) Foreign Application Priority Data

Oct. 15, 2002 (JP) ..... 2002-301001

(51) Int. Cl.
*B05C 1/00* (2006.01)
*B43K 27/00* (2006.01)

(52) U.S. Cl. ..... 401/17; 401/30; 401/195; 156/540

(58) Field of Classification Search ..... 401/16–21, 401/29–33, 195; 156/540, 541
See application file for complete search history.

(56) References Cited

U.S. PATENT DOCUMENTS 5,642,953 A 7/1997 Kobayashi et al.
5,890,825 A * 4/1999 Kageyama et al. ..... 401/52
6,461,068 B1 * 10/2002 Holmes ..... 401/17
6,582,514 B1 * 6/2003 Yang ..... 118/76
6,783,293 B1 * 8/2004 Watanabe et al. ..... 401/195

FOREIGN PATENT DOCUMENTS

| | | |
|---|---|---|
| DE | 1 136 611 | 9/1962 |
| FR | 2 774 331 | 8/1999 |
| GR | 990100336 | 1/1999 |
| JP | 10-025056 | 1/1998 |
| WO | WO 01/25025 A1 | 4/2001 |

* cited by examiner

*Primary Examiner*—David J. Walczak
(74) *Attorney, Agent, or Firm*—McGinn IP Law Group, PLLC

(57) ABSTRACT

A composite holding tool has a space in a rear barrel to be effectively used in order to expand a range of use of one composite holding tool. The composite holding tool includes a front barrel, a rear barrel rotatably connected to the front barrel, a plurality of holding bodies housed in the front barrel non-rotatably relative to the front barrel and movably in an axial direction, a cam cylinder that rotates integrally with the rear barrel, and can selectively hold any of the plurality of holding bodies, with a tip of the holding body protruding from a tip of the front barrel, by a relative rotation between the front barrel and the rear barrel, and a cartridge connected to the rear barrel or the cam cylinder and placed in the rear barrel. A tip of the cartridge projects from a rear end of the rear barrel

9 Claims, 6 Drawing Sheets

COMPOSITE HOLDING TOOL

BACKGROUND OF THE INVENTION

1. Field of the Invention

The present invention relates to a composite holding tool that allows a plurality of media to be selectively used.

2. Description of the Related Art

A known composite holding tool of this type includes a front barrel, a rear barrel rotatably connected to the front barrel, a plurality of holding bodies that are housed in the front barrel non-rotatably relative to the front barrel and movably in an axial direction, and always urged backward, and a cam cylinder that rotates together with the rear barrel, and can selectively hold any of the plurality of holding bodies holding a medium, with a tip of the holding body projecting from a tip of the front barrel, by a relative rotation between the front barrel and the rear barrel (for example, see Japanese Patent Laid-Open No. 2001-328393 and Japanese Patent Laid-Open No. 11-208186.

In such a conventional composite holding tool, a holder is provided at a rear end of the rear barrel and houses an eraser, a stamp seal, or the like.

However, the rear end of the rear barrel simply houses a small or disposable component such as a stamp seal or an eraser, and the space in the rear barrel is insufficiently utilized. Furthermore, a coating transfer tool using a coating transfer tape has been commercially available as a correction tool, but such a tool is bulky and, in most cases, produced and used as a single component rather than in combination with other components, and thus insufficiently used.

Furthermore, in the conventional composite holding tool, if an unnecessary force acts on the holding body when the holding body is being protruded by the cam cylinder, twist or runout occurs in the holding body to cause diametrical or circumferential displacement of the holding body rather than axial displacement, thereby the operability is spoiled.

Furthermore, in the conventional composite holding tool, the number of holding bodies to be housed is previously determined, and the holding tool has a configuration corresponding to the number. Thus, in order to change the number of holding bodies, parts or the like corresponding to the number have to be manufactured, thereby the manufacturing cost is increased.

SUMMARY OF THE INVENTION

The invention is made in view of the problems, and has an object to provide a composite holding tool that allows a space in a rear barrel or an outer barrel to be effectively used to expand a range of use of one composite holding tool. Another object of the invention is to provide a composite holding tool that incorporates a coating transfer unit, which is bulky and has not been used in combination. A further object of the invention is to provide a composite holding tool that can be smoothly operated to protrude a holding body forward. A further object of the invention is to provide a composite holding tool that can provide for changes in the number of holding bodies to be used at low costs.

In order to achieve the objects, according to a first aspect of the present invention, composite holding tool includes a front barrel, a rear barrel rotatably connected to the front barrel, a plurality of holding bodies housed in the front barrel movably in an axial direction, and a cam cylinder that rotates together with the rear barrel, and can selectively hold any of the plurality of holding bodies, with a tip of the holding body protruding from a tip of the front barrel, by a relative rotation between the front barrel and the rear barrel. A cartridge is connected to one of the rear barrel and the cam cylinder and placed in the rear barrel. A part of the cartridge projectes from a rear end of the rear barrel. Rotating the rear barrel relative to the front barrel allows any of the plurality of holding bodies to be held with the tip thereof protruding from the tip of the front barrel for selective use of the holding body. Furthermore, the cartridge placed in the rear barrel can be used from the side of the rear barrel so that a range of use of the composite holding tool can be expanded.

The cartridge can be replaceably connected to one of the rear barrel and the cam cylinder. Even if the space in the rear barrel is limited, and the cartridge has a small volume and thus has a relatively short life, the cartridge can be replaced and used during the life of the composite holding tool.

The cartridge can have an engagement portion that engages an engagement portion formed on one of the rear barrel and the cam cylinder, and an inner peripheral surface of the rear barrel matches an outer peripheral surface of the cartridge. Engagement between the engagement portion of the cartridge and the engagement portion formed on one of the rear barrel and the cam cylinder allows the cartridge to be reliably held in the rear barrel. When the outer peripheral surface of the cartridge is in a noncircular shape, matching the inner peripheral surface of the rear barrel with the noncircular shape allows circumferential positioning of the cartridge.

A window can be formed in a peripheral surface of the rear barrel so that the cartridge can be operated from outside through the window. Even if the cartridge is placed in the rear barrel, the cartridge can be operated.

A cam slider that slides along a cam surface of the cam cylinder can be connected to each of the holding bodies, the cam slider makes sliding contact with an adjacent cam slider, and the cam slider slides along the cam surface and the adjacent cam slider and is movable in the axial direction. The cam sliders make sliding contact with each other, and slide along the adjacent cam sliders, and thus the cam sliders smoothly move in the axial direction. The adjacent cam slider can prevent diametrical displacement of the cam slider, and smoothly move the holding body connected to the cam slider in the axial direction.

A ridge extending in the axial direction is formed on a surface of each cam slider in contact with the adjacent cam slider, and a groove extending in the axial direction and into which the ridge fits is formed in a portion of the adjacent cam slider corresponding to the ridge. As the ridge of the adjacent cam slider fits into the groove of the cam slider, the adjacent cam slider can prevent diametrical and circumferential displacement of the cam slider, and smoothly move the holding body connected to the cam slider in the axial direction.

In the case of that the number of the holding bodies is smaller than the number of the cam sliders, a dummy holding body is connected to a cam slider to which no holding body is connected. Using the dummy holding body allows change in the number of holding bodies to be housed within the maximum number of holding bodies to be housed, without changing components, at low costs.

A coil spring that always urges the cam slider toward the cam cylinder is wound around the holding body, and when the dummy holding body is used, the coil spring is wound around the dummy holding body. The dummy holding body allows stable placement of the coil spring.

According to a second aspect of the invention according to the present invention, a composite holding tool includes an outer barrel, a holding body that is housed in the outer barrel and holds a medium having a tip that can protrude from a tip of the outer barrel and ready for use, and a cartridge that is housed in the outer barrel and has a tip projecting from a rear end of the outer barrel. The cartridge has a casing that houses the medium to be served for use, and the casing is connected to the outer barrel. When the tip of the outer barrel is on the side of use, the medium held by the holding body housed in the outer barrel can be used. Alternatively, the outer barrel is inverted, and the rear end thereof is on the side of use, the medium housed in the casing of the cartridge housed in the outer barrel can be used. Using the cartridge from the side of the rear end of the outer barrel allows a range of use of the composite holding tool to be expanded.

The casing of the cartridge in the second aspect of the invention is detachably connected to the outer barrel. Even if the space in the outer barrel is limited, and the cartridge has a small volume and thus has a relatively short life, the casing is detached from the outer barrel, and the cartridge can be replaced and used during the life of the composite holding tool.

The cartridge maybe a tape cartridge that houses a coating transfer tape. In the case of the second aspect of the invention, the medium housed in the casing is the coating transfer tape. When the holding body is a writing barrel body, and the holding body is used to write and a writing error is happened, the composite holding tool is inverted, and the coating transfer tape is pressed onto a transferred surface to be corrected and moved, thus allowing immediate and easy correction. Therefore, one composite holding tool can be used for both writing and correction of writing to increase convenience. A combination of the coating transfer tape with other holding bodies can increase availability. Because the composite holding tool houses the plurality of holding bodies, the rear barrel has a somewhat large diameter and thus has a configuration suitable for placement of the tape cartridge therein.

Preferably, the width of the coating transfer tape is more than 0 and 7 mm or less. The coating transfer tape can be housed in the rear barrel without increasing an outer diameter of the composite holding tool. Furthermore, a minute correction spot can be easily corrected.

A base material of the coating transfer tape may be a plastic film. This can reduce the volume of the coating transfer tape or allows a long coating transfer tape to be housed in the rear barrel to prolong the useful life of the cartridge.

DETAILED DESCRIPTION OF THE PREFERRED EMBODIMENTS

Now, an embodiment of the invention will be described with reference to the drawings.

Figure 1:
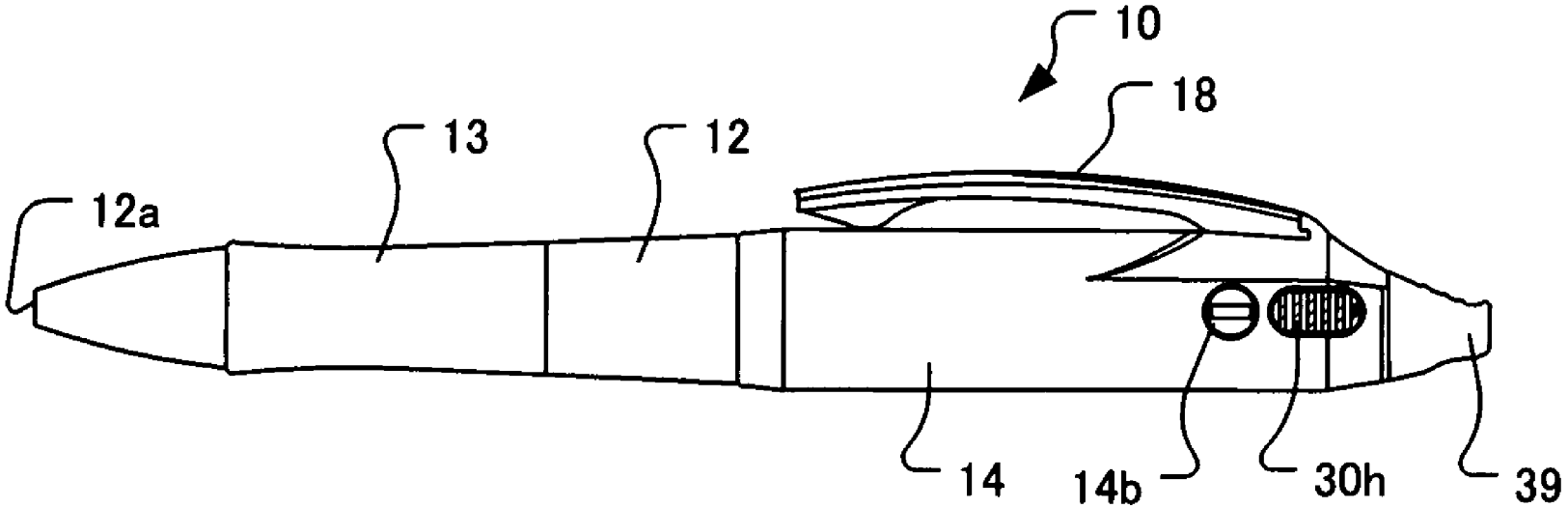
FIG. 1 is an overall view of an embodiment of a composite holding tool according to the invention.
Figure 2:
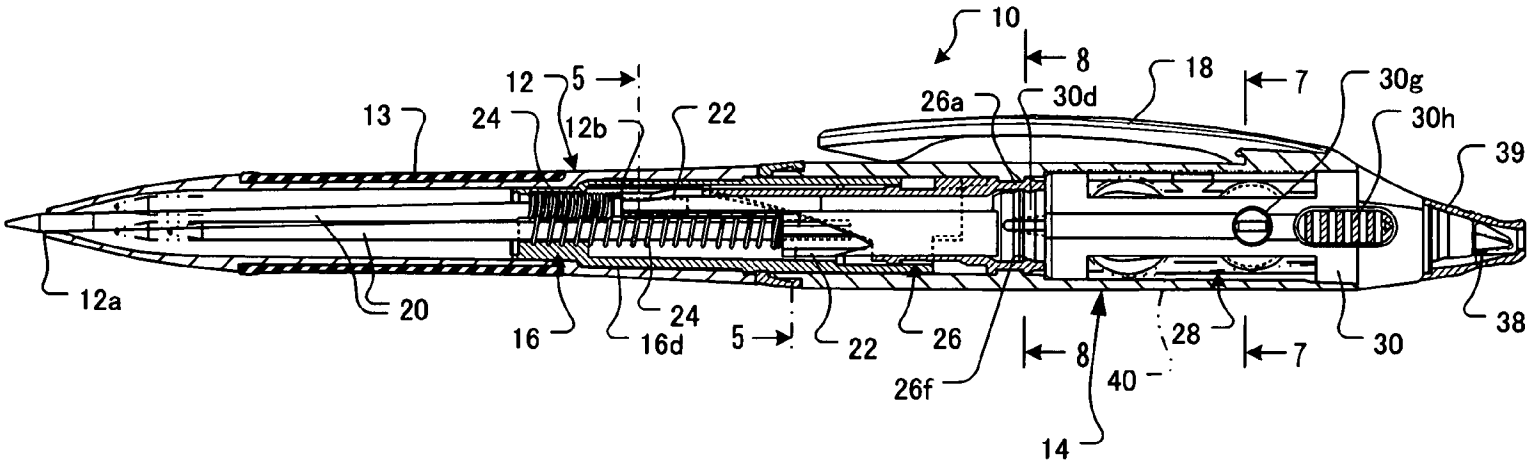
FIG. 2 is a vertical sectional view of the composite holding tool in FIG. 1.
Figure 3:
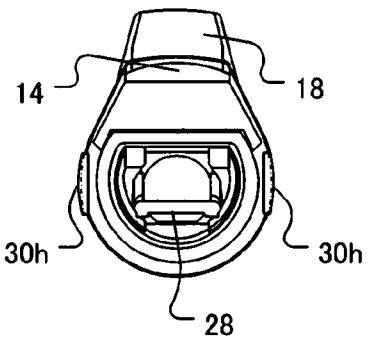
FIG. 3 is a back view of the composite holding tool in FIG. 1.

FIG. 1 is an overall view of an embodiment of a composite holding tool according to the invention, and FIG. 2 is a vertical sectional view thereof.

In the drawings, a composite holding tool 10 has a front barrel 12 and a rear barrel 14 connected to the front barrel 12. An elastic gripper 13 made of an elastic material fits around the front barrel 12. The front barrel 12 and the rear barrel 14 are rotatably and detachably connected via an intermediate barrel 16. Specifically, a rear portion of the intermediate barrel 16 is rotatably engaged to a cam cylinder 26 described below, i.e. an opening end 16*a* of the intermediate barrel 16 is engaged to an annular projection 26*g* of the cam cylinder 26 (see FIG. 4), and thus the intermediate barrel 16 is connected to the rear barrel 14 rotatably and non-detachably from the rear barrel 14. A male thread 16*d* is formed on an outer peripheral surface in a front portion of the intermediate barrel 16, a female thread 12*b* is formed on an inner peripheral surface in a rear portion of the front barrel 12, and when the male thread 16*d* and the female thread 12*b* threadably engage with each other, the intermediate barrel 16 and the front barrel 12 are integrated, while when the female thread 12*b* is disengaged from the male thread 16*d*, the front barrel 12 is separated from the intermediate barrel 16.

An outer barrel constituted by the front barrel 12, the intermediate barrel 16 and the rear barrel 14 houses a plurality of holding bodies 20, 20. In this embodiment, the holding bodies 20 are two ball point pen holding bodies that hold inks of different colors as media. However, the holding body is not limited to the ball point pen holding body, but may hold a plurality of media including stationery media such as a writing lead, solid glue or an eraser, other cosmetic media, and data input media such as a stylus tip.

Figure 4:
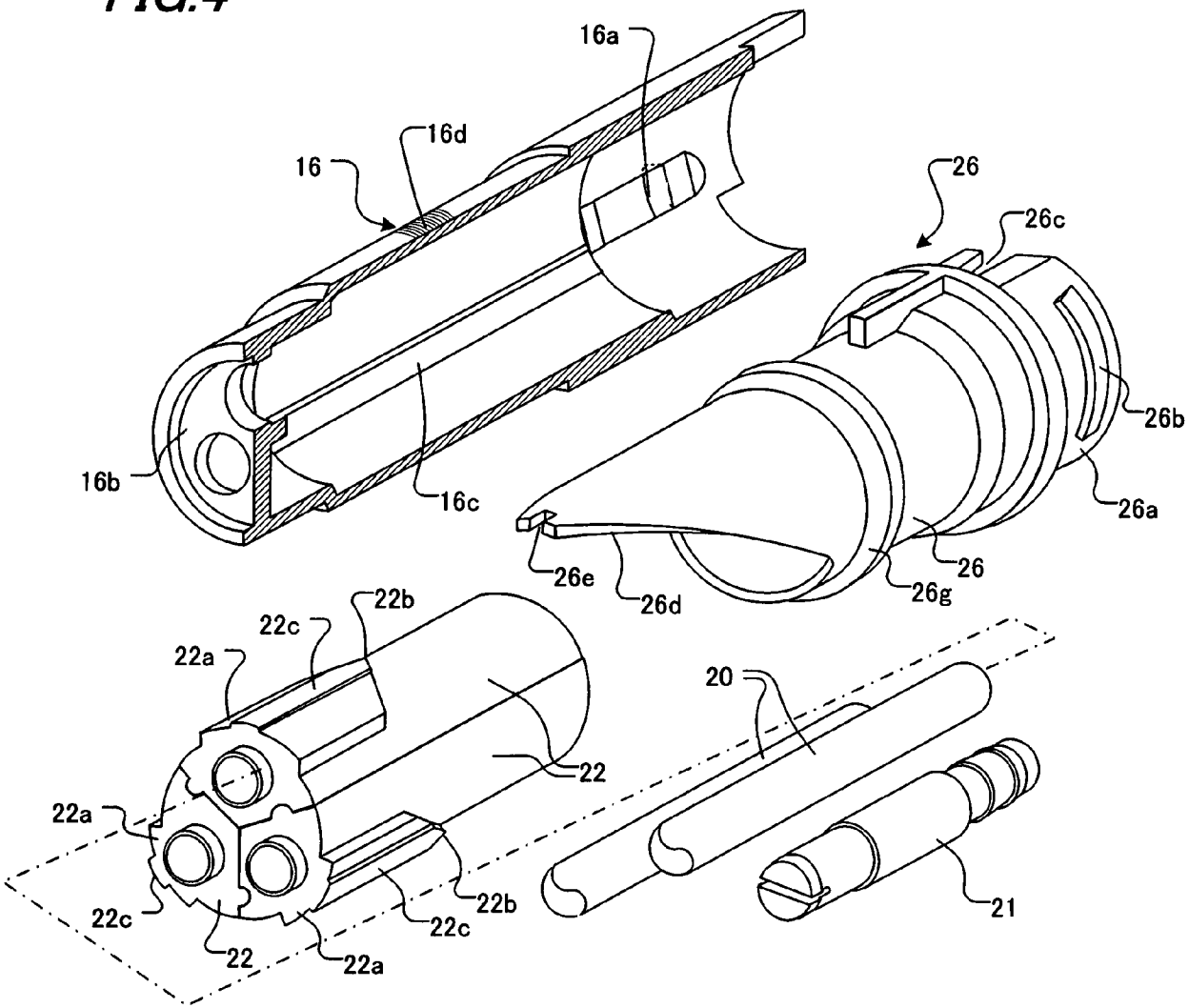
FIG. 4 is a perspective view of an intermediate barrel, a cam cylinder, a cam slider, a holding body, and a dummy holding body of the composite holding tool in FIG. 1.

As shown in FIG. 4, an inner peripheral surface in the front portion of the intermediate barrel 16 has a partition wall 16*b* that separates the plurality of holding bodies 20, and the partition wall 16*b* forms spaces corresponding to respective holding bodies 20. The holding body 20 passes through the space formed and assigned by the partition wall 16*b*. A rear end of the holding body 20 is inserted into a central hole of a cam slider 22 and connected to the cam slider 22.

Figure 5:
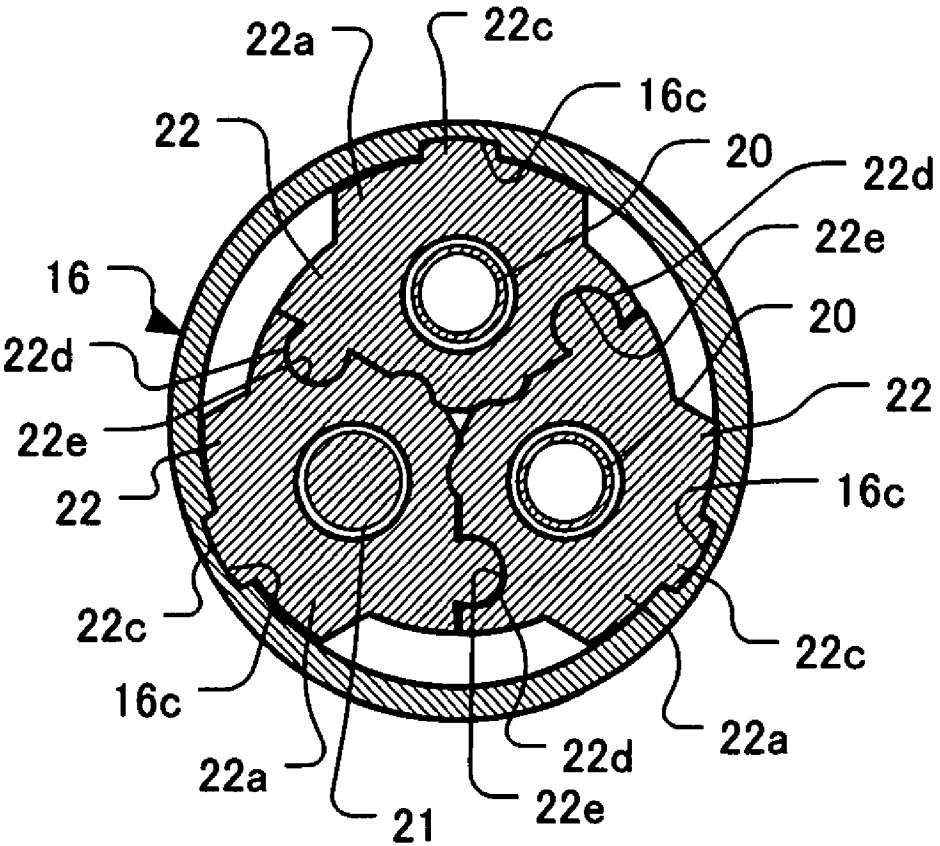
FIG. 5 is a sectional view taken along line 5—5 in FIG. 2.

As shown in FIGS. 4 and 5, the cam slider 22 has a fan-like shape in section, and the degree of opening of the fan is 360° divided by the maximum number of holding bodies to be housed. In this case, the maximum number of holding bodies 20 to be housed is three, and thus the degree of opening of the fan is 120°. The cam sliders 22 can slide in contact with surfaces of the adjacent cam sliders 22 with each other. Furthermore, the sliding contact surfaces of each cam slider 22 are not a flat surface, but has a ridge 22*d* extending in an axial direction and a groove 22*e* extending in the axial direction and into which the ridge 22*d* of one of the adjacent cam slider 22 fits. A cam projection 22*a* is formed on an outer peripheral surface of each cam slider 22, a rib 22*c* is formed on the outside of the cam projection 22*a*, and the rib 22*c* is slidably fitted into a vertical groove 16*c* formed on an inner peripheral surface in the rear portion of the intermediate barrel 16. Thus, the cam sliders 22 can slide with respect to each other and also with respect to the intermediate barrel 16, and therefore the holding body 20 connected to each cam slider 22 is placed non-rotatably relative to the front barrel 12 and movably in the axial direction. The vertical groove 16*c* of the intermediate barrel 16, and the ridge 22*d* and the groove 22*e* fitting each other prevent circumferential and diametrical displacement of each cam slider 22, and allow the cam slider 22 to smoothly move only in the axial direction.

A rear surface of a rear end of the cam projection 22*a* of the cam slider 22 is an axially inclined surface, the center of the surface projects backward the most to form a rearmost end, and the rearmost end of the cam projection 22*a* forms a sharp pointed locked portion 22*b*.

A coil spring 24 wound around each holding body 20 is inserted between a rear end surface of the partition wall 16*b* of the intermediate barrel 16 and a front end surface of the cam slider 22. The coil spring 24 always urges backward the holding body 20 together with the cam slider 22, the cam projection 22*a* is pressed against a cam cylinder 26 described below, and the rear surface of the cam projection 22*a* makes sliding contact with a front surface of the cam cylinder 26.

The cam cylinder 26 is secured non-rotatably relative to the rear barrel 14. Specifically, an engagement portion 26*a* is formed on a rear end of the cam cylinder 26, an outer peripheral surface of a cross section of the engagement portion 26*a* is in a noncircular shape, and an opening in a partition wall 14*a* (FIG. 8) formed in the rear barrel 14 matches an outline of a general surface of an outer peripheral surface of the engagement portion 26*a*. The outer peripheral surface of the engagement portion 26*a* of the cam cylinder 26 has engaging projections 26*b* and slits 26*c*, and when the engagement portion 26*a* passes through the opening in the partition wall 14*a* while deforming the slit 26*c*, the engaging projection 26*b* is engaged to the partition wall 14*a*, and the engagement portion 26*a* fits into the opening in the partition wall 14*a*, thus the cam cylinder 26 is secured to the rear barrel 14.

A front surface of the cam cylinder 26 has a cam surface 26*d* projecting forward. The center of the cam surface 26*d* projects forward the most, and a tip thereof forms a locking portion 26*e* to which the locked portion 22*b* of the cam slider 22 is locked.

Figure 8:
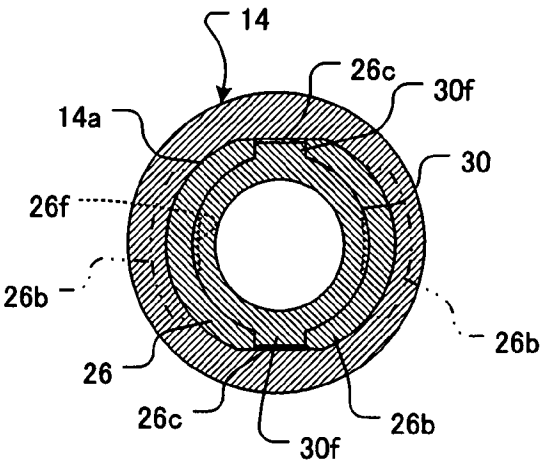
FIG. 8 is a sectional view taken along line 8—8 in FIG. 2 (without the clip)

An inner peripheral surface of the engagement portion 26*a* of the cam cylinder 26 has an engagement projection 26*f* (FIGS. 2 and 8). A tape cartridge 28 engages the engagement projection 26*f*, and the tape cartridge 28 is detachably connected to the cam cylinder 26.

Figure 9:
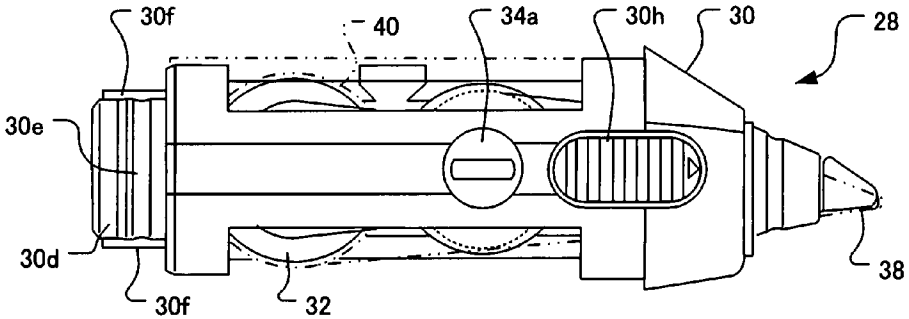
FIG. 9 is a side view of a tape cartridge in FIG. 2.
Figure 10:
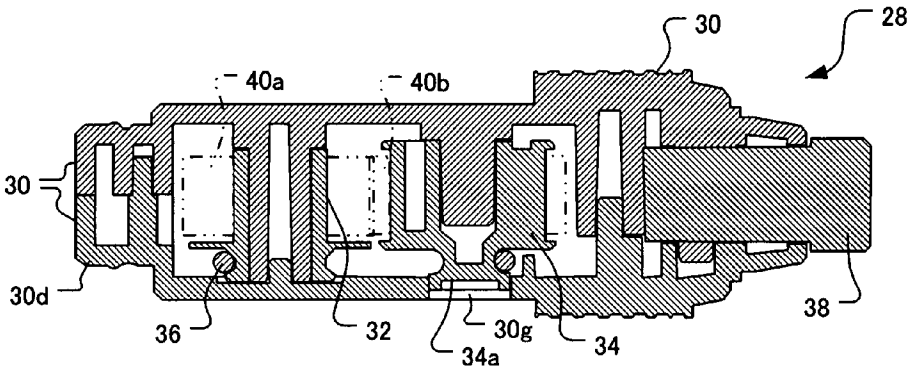
FIG. 10 is a sectional view of a tape cartridge taken along line 10—10 in FIG. 11.
Figure 11:
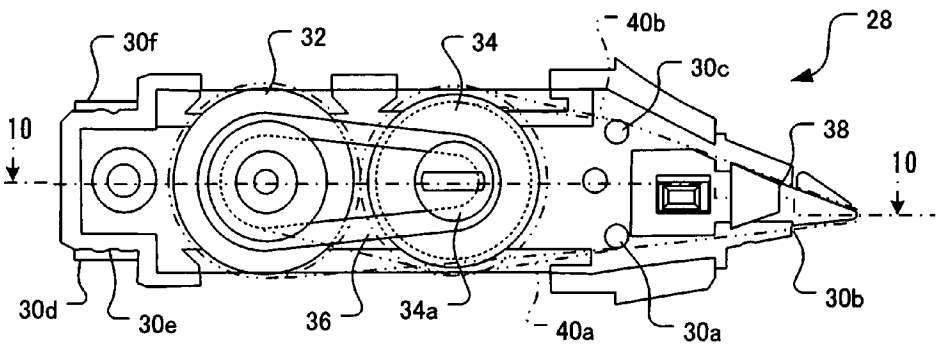
FIG. 11 is an inside view of the tape cartridge in FIG. 2 with a casing partially removed.

The tape cartridge 28 includes, as shown in FIGS. 9 to 11, a casing 30, an unwinding core 32 that is journaled in the casing 30 and around which an unused tape 40*a* of a coating transfer tape 40 is wound, a winding core 34 that is journaled in the casing 30 and winds up a used tape 40*b* unwound from the unwinding core 32, an O-ring 36 that is hung between the unwinding core 32 and the winding core 34 and is transmitting means that transmits rotation therebetween in a slippable manner, a transfer head 38 that is provided in a midpoint of a running path of the tape running between the unwinding core 32 and the winding core 34 and protrudes from the rear barrel 14, and a cap 39 placed over the transfer head 38 for protecting the transfer head 38 when unused. The tape cartridge 28 is small so as to be housed in the rear barrel 14, and the coating transfer tape 40 is also extremely thin and narrow. For example, the coating transfer tape 40 is formed in such a manner that a plastic film base material is overlaid, via an exfoliation agent layer, with an intended coating layer such as a white coating layer, and then overlaid with an adhesive layer such as a pressure sensitive adhesive layer. The thin coating transfer tape 40 can reduce the volume of the coating transfer tape 40 or allows a long coating transfer tape 40 to be housed in the rear barrel 14 to prolong the useful life of the tape cartridge 28. The width of the coating transfer tape 40 is preferably 7 mm or less, and more preferably 5 mm or less. The narrow tape allows a minute correction spot to be easily corrected.

The unused tape 40*a* of the coating transfer tape 40 unwound from the unwinding core 32 is guided by a guide pin 30*a* provided in the casing 30, and projects from an opening 30*b* of the casing 30 to be placed around a tip of the transfer head 38. The unused tape 40*a* becomes the used tape 40*b* after pressed onto a transferred surface and transferred thereto at the tip of the transfer head 38. The used tape 40*b* returns from the opening 30*b* into the casing 30, guided by a guide pin 30*c* and wound up by the winding core 34.

An end opposite to the opening 30*b* of the casing 30 is an engagement portion 30*d* having a somewhat smaller diameter than a body of the casing 30, and the engagement portion 30*d* has an engagement projection 30*e* and ribs 30*f*. The engagement projection 30*e* is locked to the engagement projection 26*f* of the engagement portion 26*a* of the cam cylinder 26, and the ribs 30*f* are fitted into the slits 26*c* of the engagement portion 26*a* of the cam cylinder 26, thus the casing 30 detachably engages the cam cylinder 26.

A side surface of the casing 30 has a window 30*g* that an extension 34*a* of an axis of the winding core 34 faces. Correspondingly to the window 30*g*, a side surface of the rear barrel 14 has a window 14*b*. The extension 34*a* of the winding core 34 can be rotationally operated from outside through the windows 14*b* and 30*g*. Furthermore, a grip 30*h* having an uneven outer surface is provided in a protruding manner on each side surface of the casing 30, and correspondingly to the grip 30*h*, a notch 14*c* that receives the grip 30*h* is formed in a rear end of the peripheral surface of the rear barrel 14 (see FIG. 6).

Figure 6:
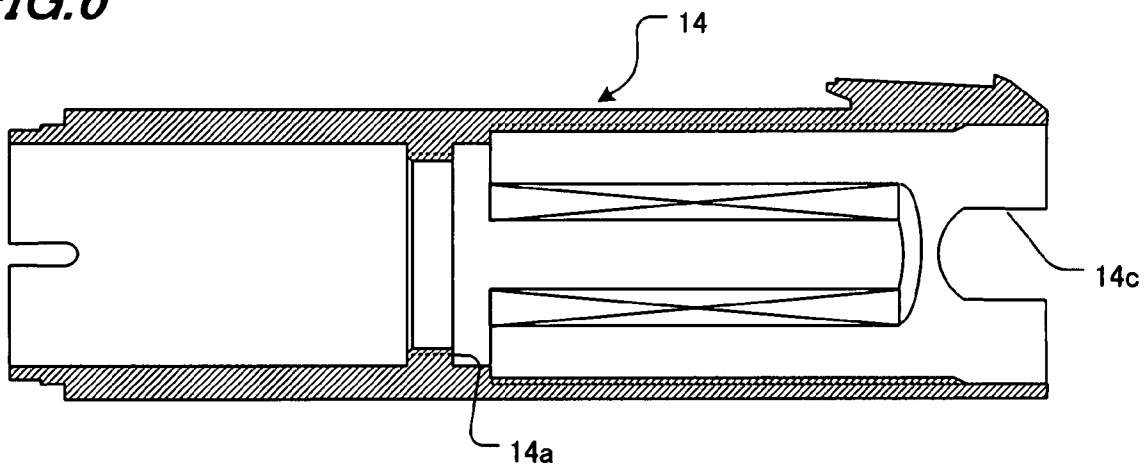
FIG. 6 is a vertical sectional view of a rear barrel.
Figure 7:
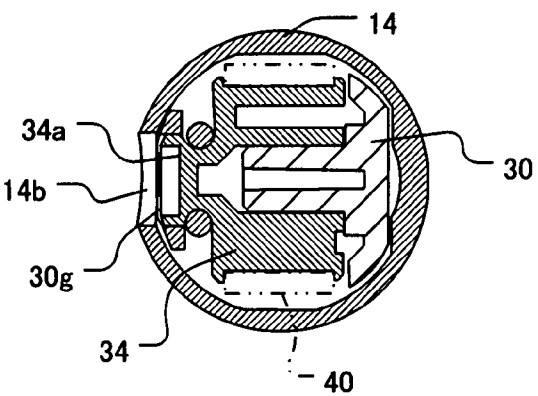
FIG. 7 is a sectional view taken along line 7—7 in FIG. 2 (without a clip)

A clip 18 is provided on the rear barrel 14. The clip 18 may be a component different from or integral with the rear barrel 14. In the case of that the clip 18 is a different component from the rear barrel 14, for example, the clip 18 is made of a material different from that of the rear barrel 14. If the rear barrel 14 is made of resin, the clip 18 can be made of metal to provide a quality appearance. As shown in FIGS. 6 and 7, an inner peripheral surface of the rear barrel 14 matches an outline of an outer peripheral surface of the casing 30.

In this embodiment, the maximum number of holding bodies 20 to be housed is three, but the number of the holding bodies 20 actually housed is two. A dummy holding body 21 is connected instead of the holding body 20 to one of the three cam sliders 22. Then, the coil spring 24 is wound around the dummy holding body 21, and urges backward the cam slider 22 to which the dummy holding body 21 is connected. Using such a dummy holding body 21 allows changes in the number of holding bodies 20 to be housed within the maximum number of holding bodies to be housed, without changing parts, at low costs.

An operation of the composite holding tool configured as described above will be described. First, when the holding body 20 is unused, the locked portion 22*b* of the cam slider 22 connected to the holding body 20 abuts against the cam surface 26*d* behind the locking portion 26*e* of the cam surface 26*d* of the cam cylinder 26. When any of the plurality of holding bodies 20 is to be used, the rear barrel 14 is rotated relative to the front barrel 12. This causes the cam cylinder 26 secured to the rear barrel 14 to rotate together with the rear barrel 14. On the other hand, the cam slider 22 non-rotatable relative to the front barrel 12 and the intermediate barrel 16 does not rotate, thus the cam projection 22*a* of the cam slider 22 slides on the cam surface 26*d* of the cam cylinder 26, any of the plurality of cam sliders 22 moves forward along the cam surface 26*d*, the locked portion 22*b* of the cam projection 22*a* is locked to the locking portion 26*e* of the cam surface 26*d*, and the holding body 20 connected to the cam slider 22 is held in an advancing state. The cam projections 22*a* of the other cam sliders 22 move backward along the cam surface 26*d* of the cam cylinder 26. The tip of the holding body 20 that has advanced protrudes from a tip protrusion opening 12*a* of the front barrel 12, and the holding body 20 is ready for use.

On the other hand, when correction is required during writing using the holding body 20 as the ball point pen holding body, the composite holding tool 10 is inverted, the cap 39 placed over the transfer head 38 of the rear barrel 14 is detached, and the transfer head 38 is pressed onto the transferred surface to be corrected and moved, thus the unused tape 40*a* of the coating transfer tape 40 is unwound from the unwinding core 32, and the coating layer is transferred to a correction spot. The used tape 40*b* from which the coating layer is transferred is wound up by the winding core 34. When the winding core 34 requires to be rotated, the extension 34*a* can be rotated through the window 14*b* of the rear barrel 14 and the window 30*g* of the casing 30.

In this way, when a writing error occurs during writing using the ball point pen holding body 20, the composite holding tool 10 is inverted, and the coating transfer tape 40 is pressed onto the transferred surface to be corrected and moved, thus executing immediate and easy correction. Therefore, one composite holding tool 10 can be used both for writing and correction of writing to increase convenience.

When ink of the ball point pen holding body 20 runs out, the front barrel 12 is detached from the intermediate barrel 16, the ball point pen holding body 20 is drawn and detached from the cam slider 22, and then a new ball point pen holding body 20 is connected to the cam slider 22 for replacement. When the unused tape 40*a* of the coating transfer tape 40 completely becomes the used tape 40*b* and can be no longer used, the tape cartridge 28 is drawn and detached from the cam cylinder 26 with the grip 30*h* of the casing 30 held, and then a new tape cartridge 28 is connected to the cam cylinder 26 for replacement. When the new tape cartridge 28 is inserted, the grip 30*h* of the casing 30 is fitted into the notch 14*c* of the rear barrel 14 to align the window 30*g* of the casing 30 with the window 14*b* of the rear barrel 14, and align the rib 30*f* of the engagement portion 30*d* of the casing 30 with the slit 26*c* of the engagement portion 26*a* of the cam cylinder 26 in the rear barrel 14. Thus, the tape cartridge 28 can engage the cam cylinder 26.

As described above, according to the invention, the tape cartridge 28 is housed in the rear barrel 14 of the composite holding tool 10, and thus the inside of the rear barrel 14 can be effectively used to expand a range of use of the composite holding tool 10. Because the composite holding tool 10 houses the plurality of holding bodies 20, the rear barrel 14 has a somewhat large diameter and thus has a configuration suitable for placement of the tape cartridge 28 therein. Further, the tape cartridge 28 can be replaced by an easy operation to increase convenience. Therefore, even if the tape cartridge 28 has a small volume and the length of the coating transfer tape 40 is limited, the tape cartridge 28 can be replaced and then used again.

In this embodiment, the tape cartridge 28 engages the cam cylinder 26 and is indirectly connected to the rear barrel 14, but not limited to this, the tape cartridge 28 may directly engage and connect to the rear barrel 14. The rear barrel 14 and the cam cylinder 26 may be integrally formed. Further, in this embodiment, the outer barrel houses the plurality of holding bodies 20, and each holding body 20 selectively protrudes from the tip protrusion opening 12*a* of the front barrel 12 (that is, the tip of the outer barrel), but not limited to this, the outer barrel may house a single holding body 20 and the tape cartridge 28 only. In this case, the holding body 20 may always project from the tip protrusion opening 12*a* of the front barrel 12, or may be operated to protrude or retract.

As described above, according to the invention, the cartridge is placed in the rear barrel of the composite holding tool, and thus using the cartridge from the rear end of the rear barrel allows a range of use of the composite holding tool to be expanded.

What is claimed is:

1. A composite holding tool comprising:

a front barrel;

a rear barrel rotatably connected to the front barrel;

a plurality of holding bodies housed in the front barrel movably in an axial direction;

a cam cylinder that rotates integrally with the rear barrel, and can selectively hold any of the plurality of holding bodies, with a tip of the holding body protruding from a tip of the front barrel, by a relative rotation between the front barrel and the rear barrel; and a cartridge connected to one of said rear barrel and said cam cylinder and placed in said rear barrel, a part of said cartridge projecting from a rear end of the rear barrel, wherein a cam slider that slides along a cam surface of said cam cylinder is connected to each of said holding bodies, said cam slider makes sliding contact with an adjacent cam slider, and the cam slider slides along the cam surface and the adjacent cam slider and is movable in the axial direction, wherein a ridge extending in the axial direction is formed on a surface of each cam slider in contact with the adjacent cam slider, and a groove extending in the axial direction and into which said ridge fits is formed in a portion of the adjacent cam slider corresponding to the ridge.

2. The composite holding tool according to claim 1, wherein said cartridge is replaceably connected to one of the rear barrel and the cam cylinder.

3. The composite holding tool according to claim 1, wherein said cartridge includes an engagement portion that engages an engagement portion formed on one of said rear barrel and said cam cylinder, and an inner peripheral surface of the rear barrel matches an outer peripheral surface of the cartridge.

4. The composite holding tool according to claim 1, wherein a window is formed in a peripheral surface of said rear barrel, and the cartridge can be operated from outside through the window.

5. The composite holding tool according to claim 1, wherein in the case of that the number of said holding bodies is smaller than the number of the cam sliders, a dummy holding body is connected to a cam slider to which no holding body is connected.

6. The composite holding tool according to claim 5, wherein a coil spring that always urges said cam slider toward the cam cylinder is wound around the holding body, and when the dummy holding body is used. The coil spring is wound around the dummy holding body.

7. A composite holding tool comprising:

a front barrel;

a rear barrel rotatably connected to the front barrel;

a plurality of holding bodies housed in the front barrel movably in an axial direction;

a cam cylinder that rotates integrally with the rear barrel, and can selectively hold any of the plurality of holding bodies, with a tip of the holding body protruding from a tip of the front barrel, by a relative rotation between the front barrel and the rear barrel; and a cartridge connected to one of said rear barrel and said cam cylinder and placed in said rear barrel, a part of said cartridge projecting from a rear end of the rear barrel, wherein said cartridge comprises a tape cartridge that houses a coating transfer tape.

8. The composite holding tool according to claim 7, wherein the width of said coating transfer tape is more than 0 and 7 mm or less.

9. The composite holding tool according to claim 7, wherein a base material of said coating transfer tape comprises a plastic film.

* * * * *